US010499483B2

(12) United States Patent
Yoneda et al.

(10) Patent No.: US 10,499,483 B2
(45) Date of Patent: Dec. 3, 2019

(54) ILLUMINATION LIGHT CONTROL SYSTEM AND SWITCHING UNIT

(71) Applicant: OMRON CORPORATION, Kyoto-shi, Kyoto (JP)

(72) Inventors: Gen Yoneda, Yamaga (JP); Naoki Motoyama, Yamaga (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 16/339,490

(22) PCT Filed: Oct. 26, 2017

(86) PCT No.: PCT/JP2017/038686
§ 371 (c)(1),
(2) Date: Apr. 4, 2019

(87) PCT Pub. No.: WO2018/110111
PCT Pub. Date: Jun. 21, 2018

(65) Prior Publication Data

US 2019/0239326 A1 Aug. 1, 2019

(30) Foreign Application Priority Data

Dec. 15, 2016 (JP) ..... 2016-243334

(51) Int. Cl.
*H01J 1/60* (2006.01)
*H05B 37/03* (2006.01)
(Continued)

(52) U.S. Cl.
CPC ..... *H05B 37/03* (2013.01); *B63B 45/02* (2013.01); *H05B 33/089* (2013.01); *B63B 45/00* (2013.01); *B63B 2045/005* (2013.01)

(58) Field of Classification Search
CPC ..... B63B 45/00; B63B 2045/005
(Continued)

(56) References Cited

U.S. PATENT DOCUMENTS 6,592,412 B1 * 7/2003 Geil ..... B63B 1/042 114/144 E
2012/0217873 A1 8/2012 Tanaka

FOREIGN PATENT DOCUMENTS

CN 201893982 U 7/2011
CN 201928485 U 8/2011
(Continued)

OTHER PUBLICATIONS

An English translation of the International Search Report ("ISR") of PCT/JP2017/038686 dated Dec. 19, 2017.
(Continued)

*Primary Examiner* — Thuy V Tran
(74) *Attorney, Agent, or Firm* — Metrolex IP Law Group, PLLC

(57) ABSTRACT

Provided is a technique that facilitates control of a navigation light which uses light-emitting diodes for a light source. This navigation light control system is provided with: a navigation light that has a light source for which a light-emitting diode is used; a power supply unit that supplies power to the navigation light; and a control device that controls lighting of the navigation light, wherein the control device is provided with a light source circuit that supplies the power received from the power supply unit to the light source, and a determination unit that determines failure of the light source on the basis of the value of the current flowing through a resistor connected to the light source circuit.

6 Claims, 7 Drawing Sheets

(51) Int. Cl.

| | |
|---|---|
| ***B63B 45/02*** | (2006.01) |
| ***H05B 33/08*** | (2006.01) |
| *B63B 45/00* | (2006.01) |

(58) Field of Classification Search
USPC ..... 315/130, 131
See application file for complete search history.

(56) References Cited

FOREIGN PATENT DOCUMENTS

| | | | |
|---|---|---|---|
| CN | 201951690 | U | 8/2011 |
| CN | 102256406 | A | 11/2011 |
| JP | 2011-100666 | A | 5/2011 |
| JP | 2014-160562 | A | 9/2014 |
| JP | 5650344 | B1 | 11/2014 |
| JP | 2015-74339 | A | 4/2015 |
| JP | 2016-066433 | A | 4/2016 |
| TW | I440275 | B | 6/2014 |

OTHER PUBLICATIONS

An English translation of the International Searching Authority ("ISA") Written Opinion ("WO") of PCT/JP2017/038686 dated Dec. 19, 2017.

* cited by examiner

ILLUMINATION LIGHT CONTROL SYSTEM AND SWITCHING UNIT

TECHNICAL FIELD

The invention relates to a navigation light control system, an illumination light control system, and a switching unit.

BACKGROUND ART

The Act on Preventing Collisions at Sea stipulates that a vessel shall display a light provided in the Act between sunset and sunrise. Examples of the light provided in the Act, namely, a navigation light include a bow light, a side light, and a stern light. A navigation officer views the navigation light of the other vessel to determine a size and a direction of the vessel at night. Therefore, if the navigation light is turned off due to a failure or the like, the state of the vessel cannot be correctly grasped by the other vessel, which disturbs safe sea traffic. Accordingly, a control apparatus that outputs an alarm and switches the light source to a standby light source when the light source of the navigation light is turned off due to the failure, is known.

Further, although a bulb has been used as the light source of the navigation light, the bulb is replaced with an LED in recent years in order to save power, etc. Patent document 1 discloses a control apparatus that controls lighting of a navigation light using the LED.

CITATION LIST

Patent Literature

[Patent document 1] Japanese Patent No. 5650344

SUMMARY OF THE INVENTION

Technical Problem

In the control apparatus that controls lighting of the existing navigation light using an incandescent bulb as the light source, an incandescent bulb in an active system and an incandescent bulb in a standby system are connected through a relay, and the incandescent bulb in the standby system is turned on when the incandescent bulb in the active system fails. More specifically, a coil of the relay is connected to a power supply path to the incandescent bulb in the active system, and a B-contact of the relay is connected to a power supply path to the incandescent bulb in the standby system. In a normal state, the coil is excited by the power supplied to the incandescent bulb in the active system to keep the B-contact open. If the incandescent bulb in the active system fails and the supply of the power is interrupted, the coil is not excited and the B-contact is closed, which turns on the incandescent bulb in the standby system.

As described above, the light source of the navigation light is changed from the bulb to the LED in recent years. In a case where the navigation light is changed to a navigation light using the LED as the light source, the control apparatus and the wiring are also changed to a control apparatus and a wiring corresponding to the LED, which takes much labor, time, and cost. Therefore, the change cannot be easily performed. For example, in a case of using the LED as the light source, the power consumption becomes lower than the power consumption by the incandescent bulb. Therefore, a failure of the LED cannot be detected by the relay same as the relay for the incandescent bulb, and a dedicated control apparatus designed for the LED as disclosed in Patent document 1 performs switching based on a switching signal.

The invention is made in consideration of such circumstances, and an object of the invention is to provide a technology that easily controls a light adopting a light emitting diode as a light source.

Solution to Problem

To solve the issues, a navigation light control system according to the invention includes a navigation light that includes a light emitting diode as a light source, a power supply unit that supplies power to the navigation light, and a control apparatus that controls lighting of the navigation light. The control apparatus includes a light source circuit that supplies the power from the power supply unit to the light source, and a determination section that determines a failure of the light source based on a value of a current flowing through a resistor connected to the light source circuit.

As described above, the navigation light control system according to the invention can detect the failure of the light source based on the current flowing through the resistor for failure detection, can determine the failure of a light emitting diode (LED) as the light source based on the value of the current, and can output an alarm and perform switching so as to supply power to the standby light source when it is determined that the light source fails. This enables the configuration other than the determination section to be common to a configuration in an existing system adopting the bulb as the light source, and makes it possible to easily control the navigation light adopting the LED as the light source.

Further, in the navigation light control system, the navigation light includes the light source in an active system and the light source in a standby system, the light source circuit includes an active circuit that supplies power to the light source in the active system and a standby circuit that supplies power to the light source in the standby system, and the control apparatus includes a switching section that switches a state from a state where the power is not supplied to the light source in the standby system to a state where the power is supplied to the light source in the standby system in a case where the determination section determines that the light source in the active system fails.

As described above, the navigation light control system according to the invention detects the failure of the light source based on the current flowing through the resistor for failure detection, and performs switching so as to supply the power to the light source in the standby system when the current value becomes a value indicating the failure. This enables the configuration other than the determination section to be common to a configuration in an existing system adopting the bulb as the light source, and makes it possible to easily control the navigation light adopting the LED as the light source.

Further, in the navigation light control system, a plurality of types of the light sources in the active system may be provided, and the resistor may have a resistance value determined for each of the types of the light sources.

As a result, the navigation light control system according to the invention can perform failure determination with an appropriate condition determined for each of the types of the light sources, and can accurately detect the failure of the light source.

Further, the determination section may determine that the light source fails in a case where the current flowing through the resistor satisfies a predetermined condition for failure determination of the light source even after a predetermined time elapses after the current satisfies the predetermined condition.

As a result, the navigation light control system according to the invention can prevent inching by the switching section and can appropriately perform switching to the light source in the standby system.

Further, to solve the issues, an illumination light control system according to the invention includes an illumination light that includes a light source in an active system and a light source in a standby system, a power supply unit that supplies power to the illumination light, and a control apparatus that controls lighting of the illumination light. The control apparatus includes an active circuit that supplies power to the light source in the active system, a standby circuit that supplies power to the light source in the standby system, a determination section that determines a failure of the light source in the active system based on a value of a current flowing through a predetermined device connected to the active circuit, and a switching section that switches a state from a state where the power is not supplied to the light source in the standby system to a state where the power is supplied to the light source in the standby system in a case where it is determined that the light source in the active system fails. A bulb or a light emitting diode is selectable as the light source. When the light source is the bulb, the light source in the standby system is turned off through excitation of a coil as the predetermined device by the power supplied to the light source in the active system in a normal state and opening of a contact of a switch as the switching section, and the light source in the standby system is turned on through non-excitation of the coil by interruption of power supply to the light source in the active system due to the failure and closing of the contact of the switch as the switching section. When the light source is the light emitting diode, the light source in the standby system is turned off through opening of the contact of the switch as the switching section in a case where the value of the current flowing through a resistor as the predetermined device becomes equal to or greater than a threshold by the power supplied to the light source in the active system in the normal state, and the light source in the standby system is turned on through closing of the contact of the switch as the switching section in a case where the value of the current flowing through the resistor becomes lower than the threshold due to the failure of the light source in the active system.

As described above, the illumination light control system according to the invention can select the bulb or the light emitting diode as the light source and can turn on the light source in the standby system when the light source in the active system fails even in a case where the bulb is selected as the light source and even in a case where the light emitting diode is selected as the light source.

In the illumination light control system, a switching unit including the determination section and the switching section may be detachably provided in the control apparatus, a bulb switching unit in which the determination section includes the coil may be mounted on the control apparatus in a case where the bulb is selected as the light source, and a light emitting diode switching unit in which the determination section includes the resistor may be mounted on the control apparatus in place of the bulb switching unit in a case where the light emitting diode is selected as the light source.

As a result, the illumination light control system according to the invention can easily control the illumination light adopting the light emitting diode as the light source by easy means of mounting the light emitting diode switching unit in place of the bulb switching unit in the case where the light emitting diode is selected as the light source.

The illumination light may be a navigation light used for signal transmission from a vessel. As described above, the illumination light control system according to the invention can easily control lighting of the navigation light even in a case where the bulb or the light emitting diode is selectable as the light source of the navigation light.

Further, to solve the issues, a switching unit according to the invention is mounted on the control apparatus when the light emitting diode is used as the light source in the illumination light control system, and includes the determination section including the resistor, and the switching section.

As a result, the switching unit according to the invention can control the light emitting diode as the light source when being mounted on the illumination light control system.

Note that the means for solving the issues can be combined and used as much as possible.

Advantageous Effects of Invention

The invention makes it possible to provide a technology to easily control a light that adopts a light emitting diode as a light source.

DESCRIPTION OF EMBODIMENTS

Figure 1:
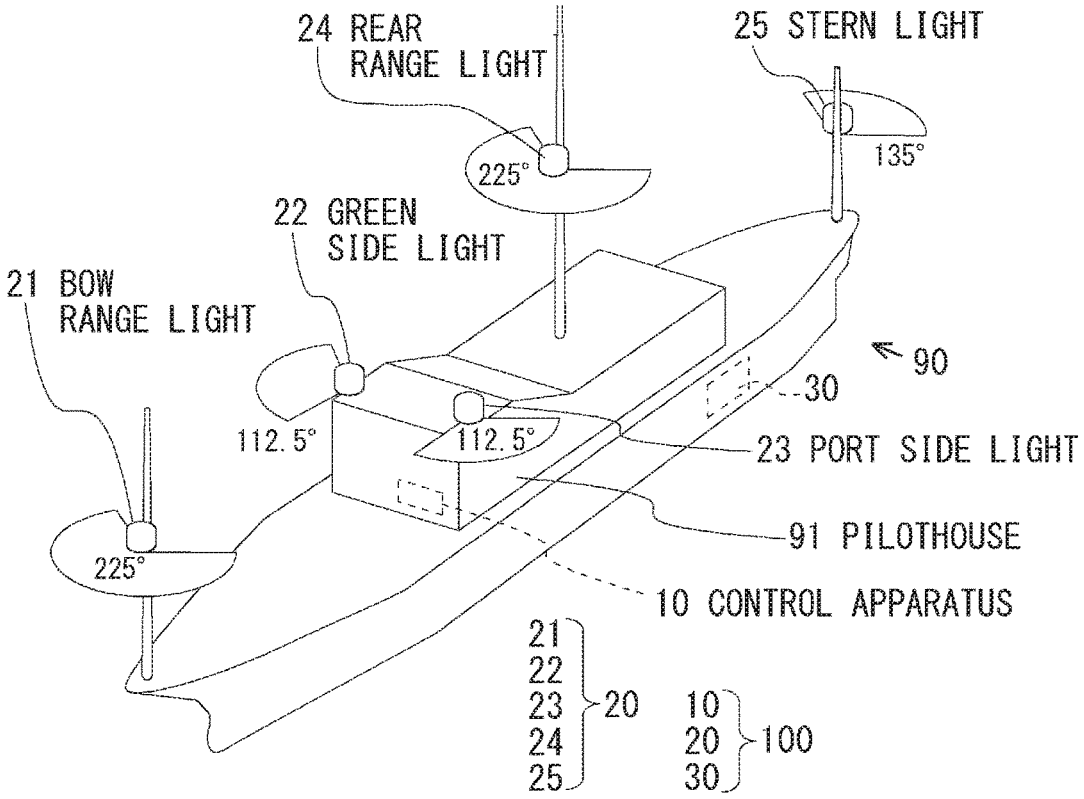
FIG. 1 is an explanatory diagram of a vessel including a navigation light control system.
Figure 2:
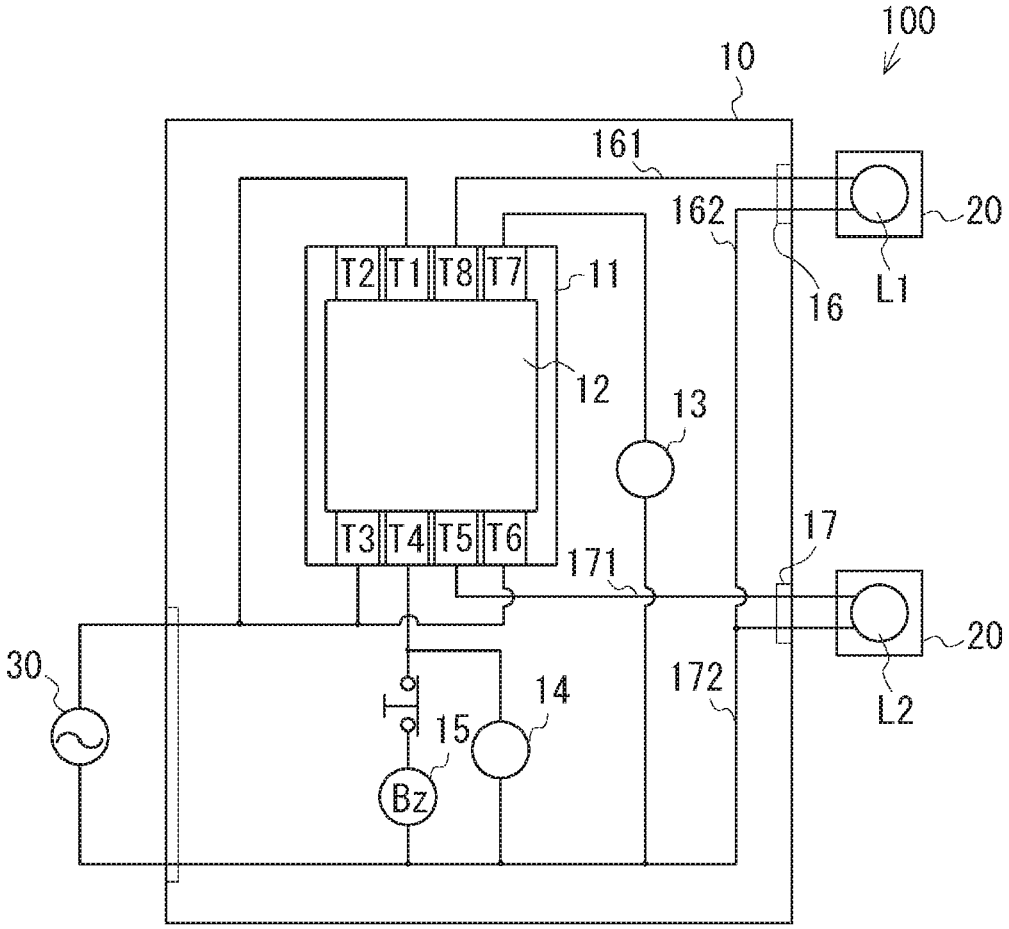
FIG. 2 is a schematic configuration diagram of the navigation light control system.

A specific embodiment adopting the technology is described in detail below with reference to drawings. FIG. 1 is an explanatory diagram of a vessel including a navigation light control system, and FIG. 2 is a schematic configuration diagram of the navigation light control system.

A vessel 90 illustrated in FIG. 1 is mounted with a navigation light control system 100 (see FIG. 2) according to an embodiment of the invention. The navigation light control system 100 includes a control apparatus 10, a navigation light 20, and a power supply unit 30. Note that the control apparatus 10 is provided in a pilothouse 91 illustrated in FIG. 1, and the power supply unit 30 is provided in an engine room (not illustrated). The navigation light control system 100 according to the embodiment is one form of an illumination light control apparatus that controls a navigation light as an illumination light mounted on the vessel 90.

The navigation light 20 includes, for example, a bow range light (a front mast-light) 21, a green side light 22, a port side light 23, a rear range light (a rear mast-light) 24, and a stern light 25. Note that, in FIG. 1, fan shapes illustrated at respective positions of the navigation lights 21 to 25 each indicate a display range of the corresponding light. As described above, although the vessel 90 in this example includes various types of navigation lights 21 to 25, the navigation lights 21 to 25 are collectively referred to as the navigation light 20 in description for common matters. Further, in the navigation light 20, a light source is duplexed (made redundant), and the navigation light 20 includes a light source L1 in an active system and a light source L2 in a standby system. The duplexing of the light source may be achieved by a configuration in which one navigation light 20 includes the light source L1 in the active system and the light source L2 in the standby system, or a configuration in which two navigation lights 20 are provided, and one of them serves as the light source in the active system and the other serves as the light source in the standby system. The control apparatus 10 performs control such that, out of these light sources L1 and L2, only the light source L1 in the active system is turned on in a normal state, and the light source L2 in the standby system is automatically turned on when the light source L1 in the active system fails.

The control apparatus 10 includes a relay unit 12, indicating lights 13 and 14, and an alarm output unit 15.

The alarm output unit 15 includes a buzzer, and can emit buzzer sound (example of alarm) when receiving supply of power. The alarm output unit 15 is not limited to the buzzer, and may perform optional operation such as output of bell sound from a bell, output of an audio message, lighting of a warning light, display of a warning message on a display, and transmission of a message to the other computer or a manager terminal as long as the alarm can be notified to a crew.

The indicating lights 13 and 14 respectively represent operation states of the light sources L1 and L2. The indicating light 13 is turned on when the light source L1 is turned on, and the indicating light 14 is turned on when the light source L2 is turned on.

A connector 16 is connected with the light source L1 in the active system. Therefore, a wiring 161 that connects the connector 16 and the relay unit 12 and a wiring 162 that connects the connector 16 and the power supply unit 30 serve as a power supply path (active circuit) to the light source L1 in the active system.

A connector 17 is connected with the light source L2 in the standby system. Therefore, a wiring 171 that connects the connector 17 and the relay unit 12 and a wiring 172 that connects the connector 17 and the power supply unit 30 serve as a power supply path (standby circuit) to the light source L2 in the standby system.

The relay unit 12 is connected to the light source L1 in the active system and the light source L2 in the standby system, and performs switching so as to turn on the light source L2 in the standby system when the light source L1 in the active system fails. Further, the relay unit 12 is connected to the indicating lights 13 and 14 and the alarm output unit 15. When the light source L1 in the active system fails, the relay unit 12 turns off the indicating light 13 and turns on the indicating light 14, and operates the alarm output unit 15. The relay unit 12 is one form of a switching unit according to the embodiment.

The relay unit 12 is connected to the control apparatus 10 through a socket 11. More specifically, the socket 11 is fixed to a substrate of the control apparatus 10, and the relay unit 12 is detachably attached to the socket 11.

Figure 3:
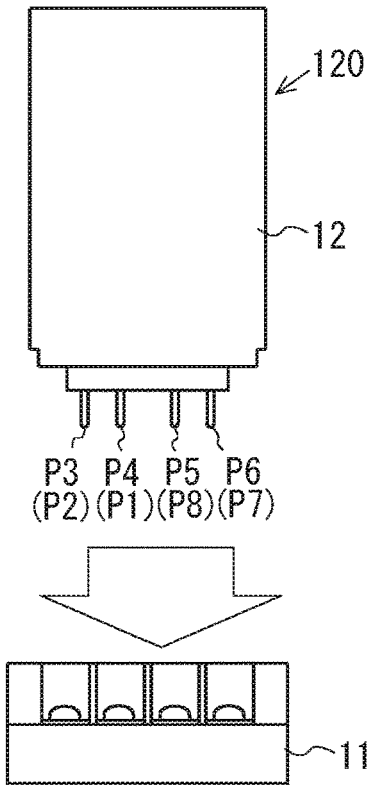
FIG. 3 is a front view of a relay unit and a socket.
Figure 4:
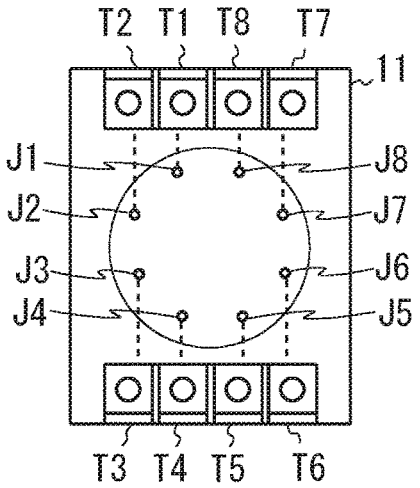
FIG. 4 is a plan view of the socket.

FIG. 3 is a front view of the relay unit 12 and the socket 11, and FIG. 4 is a plan view of the socket 11. The relay unit 12 includes pin terminals (male terminals) P1 to P8 at lower end of a housing 120, and the pin terminals P1 to P8 are respectively inserted into reception terminals (female terminals) J1 to J8 of the socket 11. The reception terminals (female terminals) J1 to J8 of the socket 11 are respectively connected to terminals T1 to T8 on a front surface and a rear surface through internal wirings as illustrated by dashed lines. In other words, the pin terminals P1 to P8 of the relay unit 12 inserted into the socket 11 are respectively connected to the terminals T1 to T8 of the socket 11.

The relay unit 12 according to the embodiment includes a bulb relay unit 12A that is used in a case where a bulb is adopted for each of the light sources L1 and L2 of the navigation light 20, and an LED relay unit 12B that is used in a case where an LED is adopted for each of the light sources L1 and L2. The bulb relay unit 12A and the LED relay unit 12B are switchable depending on the type of the light sources L1 and L2.

Figure 5:
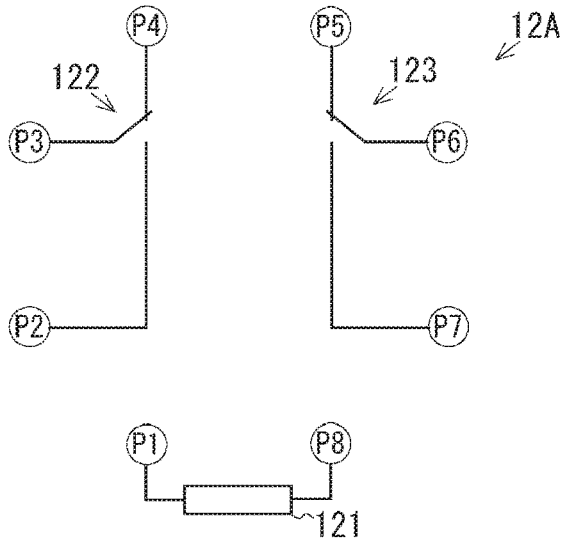
FIG. 5 is a diagram schematically illustrating a circuit inside a bulb relay unit.

FIG. 5 is a diagram schematically illustrating a circuit inside the bulb relay unit 12A. As illustrated in FIG. 5, the bulb relay unit 12A has a configuration in which a contact of a switch 122 connected to the terminals P2 to P4 and a contact of a switch 123 connected to the terminals P5 to P7 are moved through excitation of a coil 121 provided between the terminals P1 and P8, to switch ON/OFF. Note that, in the bulb relay unit 12A, each of a contact between the terminals P3 and P4 and a contact between the terminals P5 and P6 is a B-contact that is closed when the coil 121 is not excited and is opened when the coil 121 is excited, and each of a contact between the terminals P2 and P3 and a contact between the terminals P6 and P7 is an a-contact that is opened when the coil 121 is not excited and is closed when the coil 121 is excited.

As illustrated in FIG. 2, the wiring 161 serving as the power supply path of the light source L1 in the active system is connected to the terminal T8 of the socket 11, and power from the power supply unit 30 connected to the terminal T1 is supplied through the coil 121. Therefore, in a state where the light source L1 is turned on, the coil 121 is excited, the contact between the terminals P2 and P3 and the contact between the terminals P6 and P7 are closed, and the contact between the terminals P3 and P4 and the contact between the terminals P5 and P6 are opened. As a result, the indicating light 13 connected to the terminal T7 of the socket 11 is turned on, and the light source L2 in the standby system connected to the terminal T5 and the indicating light 14 connected to the terminal T4 are turned off. Further, the alarm output unit 15 connected to the terminal T4 is in a non-operating state.

In contrast, when the light source L1 in the active system fails due to burnout or the like and the power is not supplied to the power supply path (wiring 161), the coil 121 is not excited, the contact between the terminals P2 and P3 and the contact between the terminals P6 and P7 are opened, and the contact between the terminals P3 and P4 and the contact between the terminals P5 and P6 are closed. As a result, the light source L2 in the standby system connected to the terminal T5 of the socket 11 and the indicating light 14 connected to the terminal T4 are turned on, and the alarm output unit 15 outputs buzzer sound. Further, the indicating light 13 connected to the terminal T7 is turned off.

Figure 6:
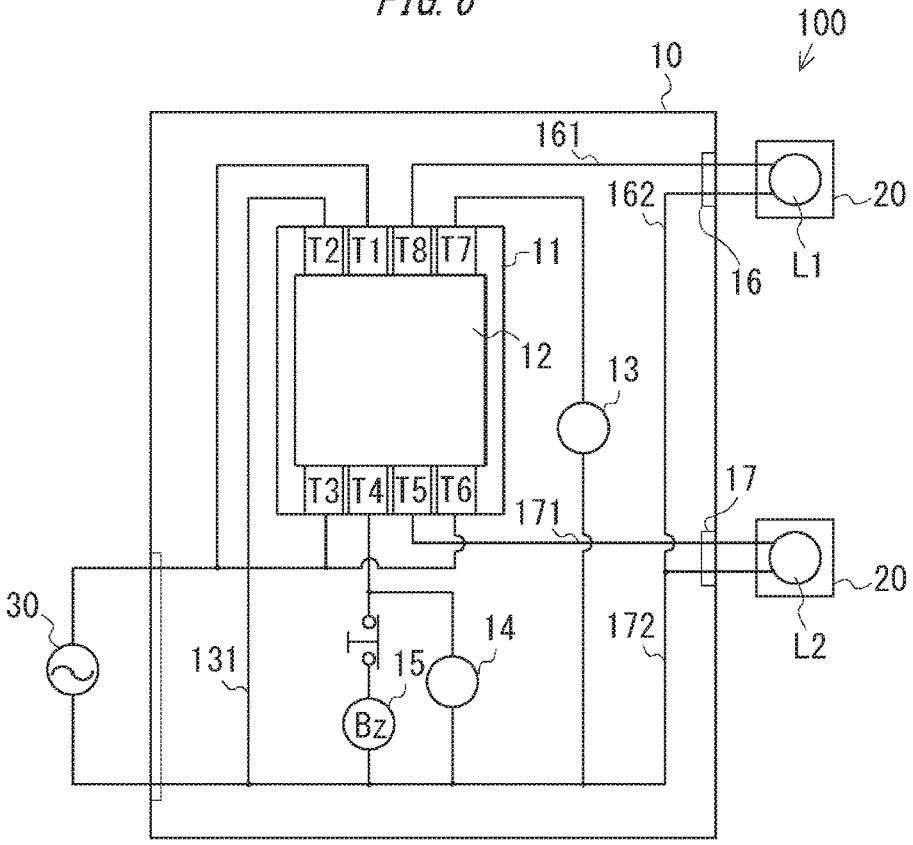
FIG. 6 is a schematic configuration diagram of a navigation light control system adopting an LED as a light source.

As described above, in a case where a bulb such as an incandescent bulb is adopted as each of the lithe sources L1 and L2, the navigation light control system 100 according to the embodiment can turn on the light source L2 in the standby system with use of the bulb relay unit 12A when the light source L1 in the active system fails. Further, in a case where an LED is adopted as each of the light sources L1 and L2, the navigation light control system 100 according to the embodiment can turn on the light source L2 in the standby system with use of the LED relay unit 12B when the light source L1 in the active system fails. FIG. 6 is a schematic configuration diagram of the navigation light control system adopting an LED for the light source. In this case, a wiring 131 that connects the terminal T2 of the socket 11 and the power supply unit 30 is provided and the power supply unit 30 is connected between the terminals T1 and T2, unlike FIG. 2.

Figure 7:
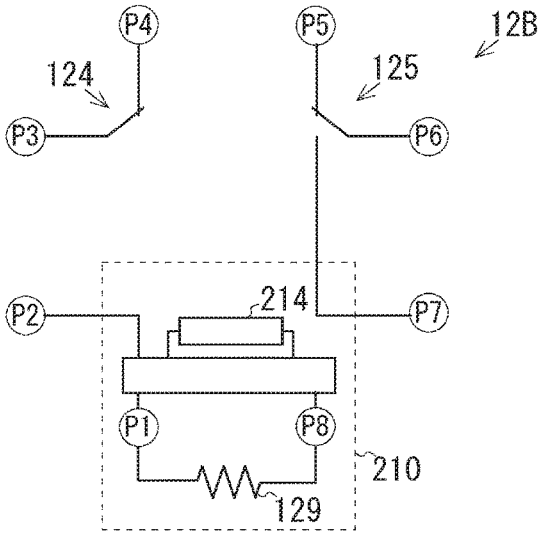
FIG. 7 is a diagram schematically illustrating a circuit inside an LED relay unit.
Figure 8:
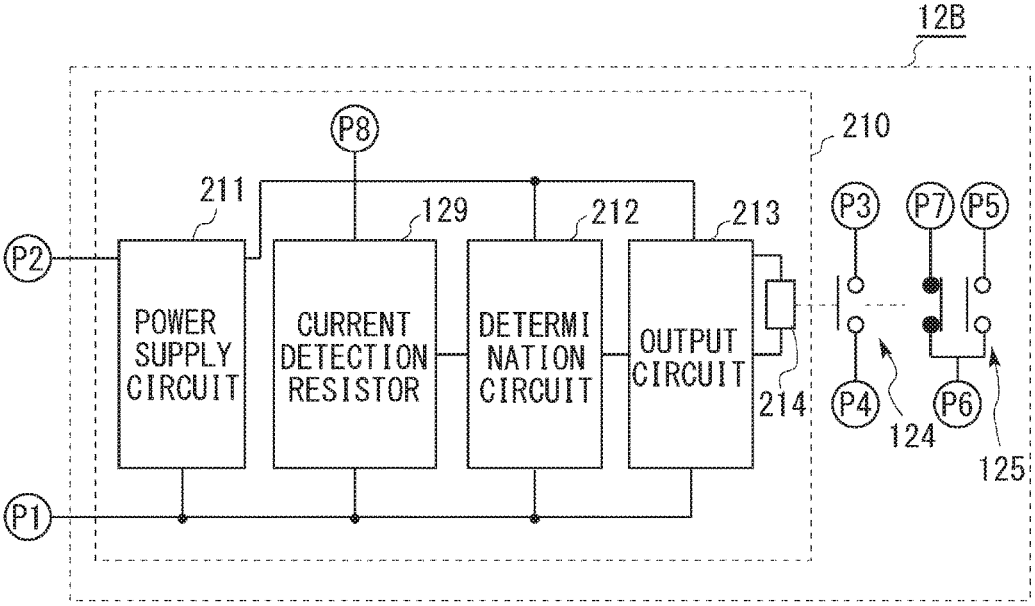
FIG. 8 is a functional block diagram of the LED relay unit.

FIG. 7 is a diagram schematically illustrating a circuit inside the LED relay unit 12B, and FIG. 8 is a functional block diagram of the LED relay unit 12B. As illustrated in FIG. 7, the LED relay unit 12B includes a drive circuit 210 that includes a resistor 129 provided between the terminals P1 and P8 in place of the coil 121 of the bulb relay unit 12A, detects the state of the light source L1 based on variation of a voltage applied to the resistor 129, and drives a contact of a switch 124 connected to the terminals P3 and P4 and a contact of a switch 125 connected to the terminals P5 to P7. Note that, in the LED relay unit 12B, each of the contact between the terminals P3 and P4 and the contact between the terminals P5 and P6 is an a-contact that is opened in the normal state (normal open) and is closed when being driven by the drive circuit 210. Further, in the LED relay unit 12B, the contact between the terminals P6 and P7 is a B-contact that is closed in the normal state (normal close) and is opened when being driven by the drive circuit 210.

As illustrated in FIG. 8, the drive circuit 210 includes a power supply circuit 211, a current detection resistor 129, a determination circuit 212, an output circuit 213, and a coil 214. The power supply circuit 211 is a circuit that supplies power to the determination circuit 212 and the output circuit 213. In the example, the power supply circuit 211 converts an AC current that is supplied from the power supply unit 30 connected to the terminals P1 and P2, into a DC current used in the determination circuit 212 and the output circuit 213.

The determination circuit (determination section) 212 determines a failure based on the current (hereinafter, also referred to as LED current) that flows to the light source L1 through the current detection resistor 129. In a case where a failure condition is satisfied, namely, in a case where the LED current becomes lower than a threshold in the embodiment, the determination circuit 212 outputs a signal indicating the failure as a determination result.

When receiving the determination result indicating the failure of the light source L1 in the active system from the determination circuit 212, the output circuit 213 excites the coil 214, and drives the contact of each of the switches 124 and 125 to close the contact between the terminals P3 and P4 and the contact between the terminals P5 and P6 and to open the contact between the terminals P6 and P7. In contrast, when not receiving the determination result indicating the failure, the output circuit 213 does not excite the coil 214. Therefore, the contact of each of the switches 124 and 125 is in the normal state, namely, the contact between the terminals P3 and P4 and the contact between the terminals P5 and P6 are opened and the contact between the terminals P6 and P7 is closed. In the embodiment, the output circuit 213 and the switches 124 and 125 are one form of a switching section. Note that, although the example adopting a movable contact relay that drives the contact of each of the switches 124 and 125 by the coil 214 has been described in the embodiment, the relay is not limited thereto, and a solid-state relay that adopts a semiconductor switching device such as a thyristor and a triac may be adopted.

As described above, in the case where an LED is adopted as each of the light sources L1 and L2, the navigation light control system 100 according to the embodiment can determine the failure of the light source L1 in the active system based on the LED current flowing through the resistor 129 and turn on the light source L2 in the standby system, with use of the LED relay unit 12B.

Note that, in the case where an LED is adopted as each of the light sources L1 and L2, each of the light sources L1 and L2 may include not only the LED but also a drive circuit driving the LED. The drive circuit converts a voltage supplied to the light sources L1 and L2 from the power supply unit 30 into a voltage for the LED, for example, in a case where the voltage supplied to the light sources L1 and L2 from the power supply unit 30 is a voltage for an existing bulb such as voltage of AC 100 V to 200 V or DC 24 V. Further, the drive circuit may include a circuit that reduces the LED current to a threshold or lower in a case where a light emitting time of the LED is accumulated and an accumulated time reaches a predetermined accumulated time, for example, a time in which it is estimated that a light amount of the LED becomes 70% or lower of an initial light amount, namely, a time set as a service life of the LED. As a result, the LED drive circuit enables the control apparatus 10 to detect that the LED reaches its service life as a failure.

Figure 9:
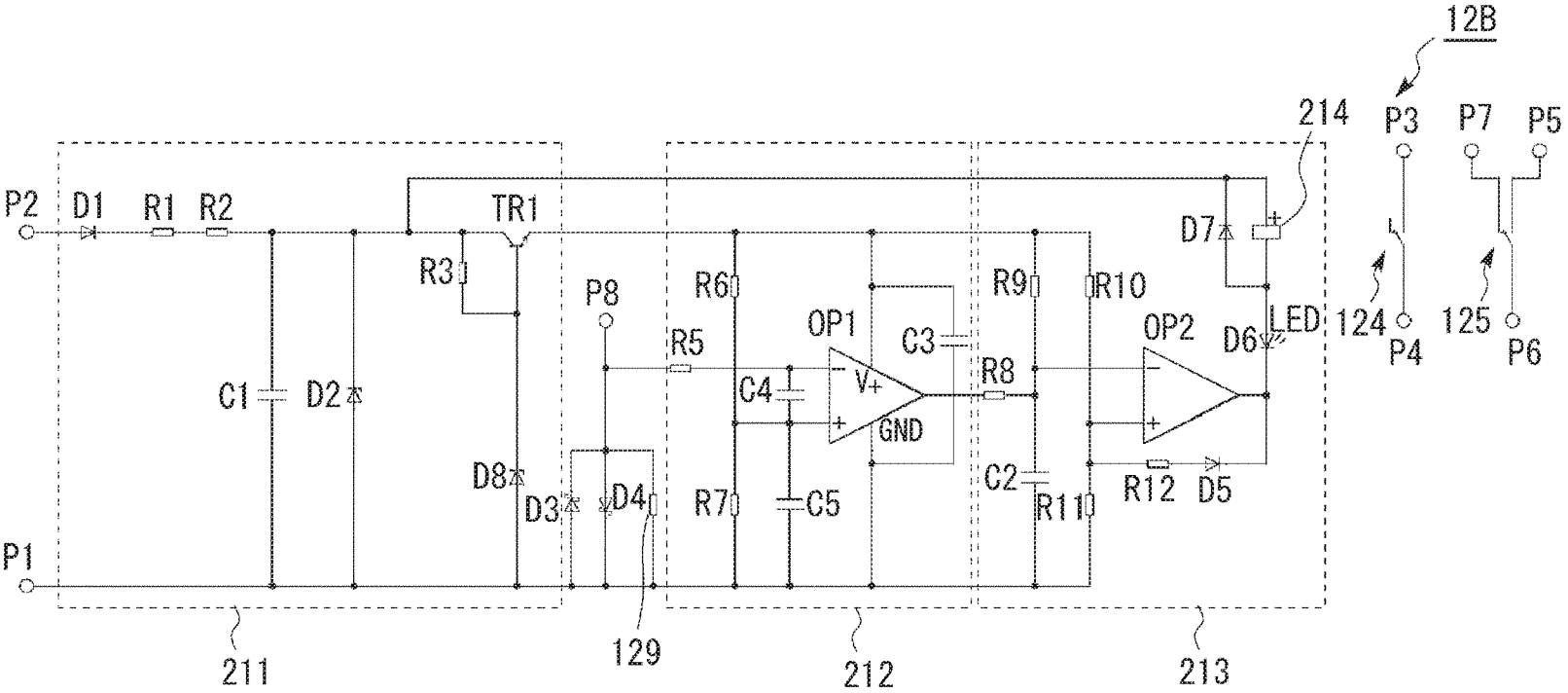
FIG. 9 is a diagram illustrating a circuit example of the LED relay unit.

FIG. 9 is a diagram illustrating a circuit example of the LED relay unit 12B. The power supply circuit 211 sets a both-end voltage of the coil 214 to a predetermined value, for example, a value equal to or lower than an allowable voltage of the relay and equal to or higher than the drive voltage during the operation of the relay (during failure of light source L1), by performing half-wave rectification with a diode D1 and dividing a voltage with resistors R1 and R2. Further, in the power supply circuit 211, a transistor TR1 and a Zener diode D8 configure a constant voltage circuit so as to apply a predetermined voltage to the determination circuit 212.

A resistance value of the resistor 129 is set such that the voltage applied to the resistor 129 when the LED current flows through the light source L1 in the normal state is coincident with a reference voltage compared by the determination circuit 212. Note that the navigation light control system according to the embodiment includes a plurality of types of the light sources L1. Therefore, the resistance value of the resistor 129 may be set for each of the types of the light source L1. For example, since the power consumption of the light source L1 is varied depending on a necessary visible distance and a color of the LED, the resistance value of the resistor 129 may be set based on the power consumption of each of the light sources L1. Moreover, the resistance value of the resistor 129 may be set based on a length of the wiring to each of the light sources L1 and a difference of the drive circuit.

The determination circuit 212 compares the voltage applied to the resistor 129 with the reference voltage by a comparator OP1 when the LED current flows through the resistor 129, and outputs the voltage corresponding to a difference therebetween as the determination result. In other words, a voltage of a predetermined value is output when the voltage applied to the resistor 129 is different from the reference voltage, to output the signal indicating the failure of the light source L1 as the determination result.

The output circuit 213 supplies power to the coil 214 based on the output of the determination circuit 212, and drives the contact of each of the switches 124 and 125. Further, the output circuit 213 includes a capacitor C2, and the output of the determination circuit 212 is accumulated in the capacitor C2 and is then provided to a comparator OP2. Thus, the output of the comparator OP2 is delayed as compared with the output of the determination circuit 212. In other words, the capacitor C2 and the comparator OP2 configure a timer circuit to prevent chattering of contact switching by the coil 214.

Figure 10:
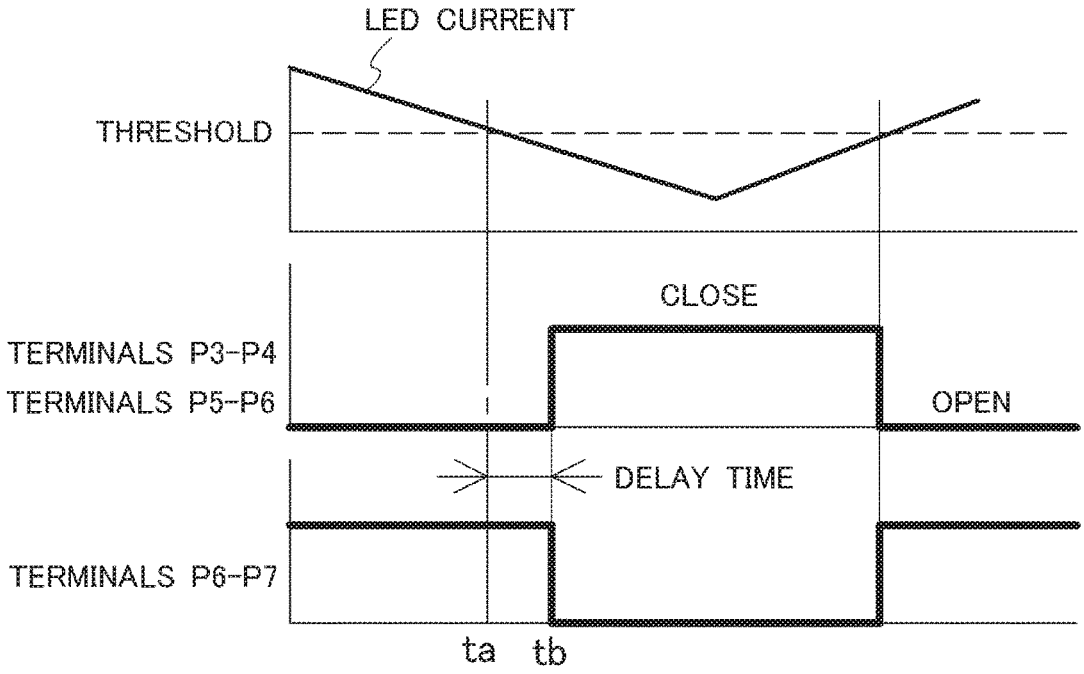
FIG. 10 is a diagram illustrating switching timing by an output circuit.

FIG. 10 is a diagram illustrating switching timing by the output circuit 213. As illustrated in FIG. 10, the output circuit 213 receives the signal indicating the failure from the determination circuit 212 at timing ta when the LED current flowing through the resistor 129 becomes lower than the threshold, and closes the contact between the terminals P3 and P4 and the contact between the terminals P5 and P6 and opens the contact between the terminals P6 and P7 at timing tb after a predetermined delay time elapses from the timing ta. Note that the delay time can be set to a time that is equal to or lower than an allowable time (for example, 1 second) until the light source L2 in the standby system is turned on after the failure and is equal to or greater than a time enough to prevent chattering. For example, the delay time is optionally settable within a range from 0.3 seconds to 1 second, and is set to 0.68 seconds in the embodiment. Further, in a case where the LED current becomes equal to or greater than the threshold due to replacement of the light source L1 or the like, the output circuit 213 opens the contact between the terminals P3 and P4 and the contact between the terminals P5 and P6, and closes the contact between the terminals P6 and P7 without delay.

As described above, according to the navigation light control system 100 of the embodiment, even when each of the light sources L1 and L2 of the navigation light 20 is replaced from a bulb to an LED, it is unnecessary to replace the whole of the control apparatus 10, and it is possible to detect the failure of the light source L1 in the active system and to turn on the light source L2 in the standby system only by replacing the bulb relay unit 12A with the LED relay unit 12B and adding the wiring 131. In other words, it is possible to easily replace the bulb with the LED as the light source of the navigation light.

The navigation light control system 100, etc. illustrated in the embodiment are not limited to those described in the embodiment, and the configuration, the operation, the operation method, etc. thereof can be appropriately modified within the technical scope of the invention.

REFERENCE SIGNS LIST

10 Control apparatus
11 Socket
12, 12A, 12B Relay unit
13, 14 Indicating light
15 Alarm output unit
16 Connector
17 Connector
20 (21 to 25) Navigation light
30 Power supply unit
90 Vessel
91 Pilothouse
100 Navigation light control system
120 Housing
121 Coil
122 to 125 Switch
129 Resistor
131 Wiring
210 Drive circuit
211 Power supply circuit
212 Determination circuit
213 Output circuit
214 Coil

The invention claimed is:

1. An illumination light control system, comprising:

an illumination light that includes a light source in an active system and a light source in a standby system;

a power supply unit that supplies power to the illumination light; and a control apparatus that controls lighting of the illumination light, wherein the control apparatus includes an active circuit that supplies power to the light source in the active system, a standby circuit that supplies power to the light source in the standby system, a determination section that determines a failure of the light source in the active system based on a value of a current flowing through a predetermined device connected to the active circuit, and a switching section that switches a state from a state where the power is not supplied to the light source in the standby system to a state where the power is supplied to the light source in the standby system in a case where it is determined that the light source in the active system fails, a bulb or a light emitting diode is selectable as the light source, when the light source is the bulb, the light source in the standby system is turned off through excitation of a coil as the predetermined device by the power supplied to the light source in the active system in a normal state and opening of a contact of a switch as the switching section, and the light source in the standby system is turned on through non-excitation of the coil by interruption of power supply to the light source in the active system due to the failure and closing of the contact of the switch as the switching section, and when the light source is the light emitting diode, the light source in the standby system is turned off through opening of the contact of the switch as the switching section in a case where the value of the current flowing through a resistor as the predetermined device becomes equal to or greater than a threshold by the power supplied to the light source in the active system in the normal state, and the light source in the standby system is turned on through closing of the contact of the switch as the switching section in a case where the value of the current flowing through the resistor becomes lower than the threshold due to the failure of the light source in the active system.

2. The illumination light control system according to claim 1, wherein a switching unit including the determination section and the switching section is detachably provided in the control apparatus, the switching unit for the bulb in which the determination section includes the coil is mounted on the control apparatus in a case where the bulb is selected as the light source, and the switching unit for the light emitting diode in which the determination section includes the resistor is mounted on the control apparatus in place of the switching unit for the bulb in a case where the light emitting diode is selected as the light source.

3. The illumination light control system according to claim 1, wherein the illumination light is a navigation light used for signal transmission from a vessel.

4. A switching unit that is mounted on the control apparatus when the light emitting diode is used as the light source in the illumination light control system according to claim 2, the switching unit comprising the determination section including the resistor, and the switching section.

5. The illumination light control system according to claim 1, wherein a plurality of types of the light sources are provided, and the resistor has a resistance value determined for each of the types of the light sources.

6. The illumination light control system according to claim 1, wherein the determination section determines that the light source fails in a case where the current flowing through the resistor satisfies a predetermined condition for failure determination of the light source even after a predetermined time elapses after the current satisfies the predetermined condition.

* * * * *